US011278063B2

(12) United States Patent
Liss

(10) Patent No.: US 11,278,063 B2
(45) Date of Patent: Mar. 22, 2022

(54) MODEST ATHLETIC SKIRT

(71) Applicant: Sara Liss, Lawrence, NY (US)

(72) Inventor: Sara Liss, Lawrence, NY (US)

( * ) Notice: Subject to any disclaimer, the term of this patent is extended or adjusted under 35 U.S.C. 154(b) by 162 days.

(21) Appl. No.: 16/795,089

(22) Filed: Feb. 19, 2020

(65) Prior Publication Data

US 2021/0251311 A1 Aug. 19, 2021

(51) Int. Cl.

| | |
|---|---|
| ***A41D 1/14*** | (2006.01) |
| ***A41D 1/08*** | (2018.01) |
| ***A41D 13/00*** | (2006.01) |
| ***A41F 1/00*** | (2006.01) |
| *A41F 17/02* | (2006.01) |

(52) U.S. Cl.

CPC ..... *A41D 1/14* (2013.01); *A41D 1/08* (2013.01); *A41D 13/0017* (2013.01); *A41F 1/00* (2013.01); *A41D 2600/10* (2013.01); *A41F 17/02* (2013.01)

(58) Field of Classification Search

CPC ..... A41D 1/14; A41D 1/08; A41D 13/0017; A41D 2600/10; A41F 1/00; A41F 17/02

See application file for complete search history.

(56) References Cited

U.S. PATENT DOCUMENTS

| | | | | |
|---|---|---|---|---|
| 1,104,632 | A * | 7/1914 | Cowen | A41D 1/086 2/212 |
| 1,247,053 | A * | 11/1917 | Wilson | A41D 1/14 2/212 |
| 1,469,287 | A * | 10/1923 | Torchia | A41B 9/005 2/408 |
| 2,429,396 | A * | 10/1947 | Colonna | A41D 15/02 2/212 |
| 8,024,819 | B2 * | 9/2011 | Gearhart | A41F 17/00 2/238 |
| 8,370,964 | B1 * | 2/2013 | Kaper | A41D 13/1236 2/46 |
| 8,857,310 | B2 * | 10/2014 | Raiser | F41H 5/08 89/36.07 |
| 11,051,568 | B2 * | 7/2021 | Reimer | A41D 3/00 |
| 2003/0229930 | A1 * | 12/2003 | Carlson | A41D 13/1254 2/114 |
| 2015/0237935 | A1 * | 8/2015 | Maryea | A41D 17/02 2/228 |
| 2016/0007662 | A1 * | 1/2016 | Powell | A41D 27/08 2/228 |
| 2016/0213071 | A1 * | 7/2016 | Vornle von Haagenfels | A41D 1/08 |

* cited by examiner

*Primary Examiner* — Khaled Annis

(57) ABSTRACT

Embodiments of the disclosure include an athletic skirt that comprises a top end configured to be worn about the waist of a wearer and at least one panel of material extending downward from the top end of the skirt. A weighted material is coupled to a lower portion of the panel of material comprising the skirt.

6 Claims, 8 Drawing Sheets

MODEST ATHLETIC SKIRT

FIELD OF THE DISCLOSED TECHNOLOGY

The disclosed technology relates generally to modest athletic-wear, and specifically, the present disclosure relates to modest garments used for athletic sport such as bicycle riding, such that the garment maintains the appearance and qualities of a skirt while cycling, and covers a portion of the rider's upper thighs.

BACKGROUND OF THE DISCLOSED TECHNOLOGY

Our Society has come to understand that exercising our body is an important pathway to health. "Movement is a medicine for creating change in a person's physical, emotional and mental states," as said by Carol Welsh, a Neuromuscular Therapist. However, for women who desire to dress modestly and/or prefer to wear garments having skirt portions covering the thigh area, certain physical activities appear to be off limits, or, at the very least, challenge one's ability to maintain modest dress. Skirts and dresses bounce up while running, hitch or fly up when cycling or riding, revealing areas many women believe in shielding and protecting from public view. A skirt that maintains coverage and modesty for women while participating in athletic sports provides the opportunity to participate in exercise and athletic events with society while honoring their deep cultural and/or religious principles and values.

While there may be many athletic skirts on the internet, a comfortable, chic, sporty, long enough skirt that would also stay down while riding is nowhere to be found. I then set about designing a modest cycling skirt that would meet the above criteria. Additionally, more charity organizations are hosting events such as marathons and bike rides to raise funds for the valuable and meaningful charity work done.

In general, there are many women and girls who ride bikes, or would like to ride, but feel that they can't because they don't have a good skirt that works! A modest cycling or athletic skirt may empower traditionally modestly dressing Morman, Muslim, and Jewish, Ammish, Christian, Hindu or other such women to enjoy the benefits of cycling, running, or other athletic activities.

SUMMARY OF THE DISCLOSED TECHNOLOGY

Embodiments of the disclosure include an athletic skirt that comprises a top end configured to be worn about the waist of a wearer and at least one panel of material extending downward from the top end of the skirt. A weighted material is coupled to a lower portion of the panel of material comprising the skirt. In embodiments, the skirt comprises pants extending downward from the top end. In an embodiment, the panel of material is configured to cover at least a portion of the pants when worn by the wearer.

In embodiments, the at least one panel of material includes a front portion that is configured to cover a front portion of the wearers body. In embodiments, the weighted material is coupled to a lower end of the skirt. In an embodiment, the panel of material is provided with a hem that extends along a lower end of the skirt, and the weighted material is secured to the hem. In an embodiment, the hem extends along an entire length of the lower end and the weighted material is sewn into the hem. In embodiments, the weighted material comprises at least one strand of weighted beads.

In an embodiment, the at least one panel includes a front portion that is configured to cover a front part of the wearers body, the at least one panel is provided with a hem that extends along a lower end of the at least one panel, and two strands of the at least one strand of weighted material are coupled to a portion of the hem that extends along a lower end of the front portion of the at least one panel. In an embodiment, the skirt further includes a first portion of a closure device coupled to an inside surface of the at least one panel, a second portion of the closure device coupled to an outer surface of the pants. The second portion of the closure device is configured to mate with the first portion of the closure device, and when positioned, the first and second portions of the device are secured, and when mated, the at least one panel is secured to the pants to cover at least a portion of the pants even when the wearer's legs are moved.

In an embodiment, the at least one panel includes a front portion that is configured to cover a front part of the wearer's body. In embodiments, the skirt further includes a first portion of a closure device attached to an inside surface of the at least one panel and a second portion of the closure device configured to mate with the first portion of the closure device and being attached to an outer surface of the pants. In embodiments, the first and second portions of the closure device are positioned so that when mated, the at least one panel is secured to the pants and covers at least a portion of the pants even when the wearer's legs are moved.

In embodiments, the pants are configured to extend below the wearer's knees, and the first and second portions of the closure device are positioned so that when mated, the at least one panel is secured to the pants to cover at least a portion of the pants that extends to below the wearer's knees. In embodiments, the closure device is a hook and loop closure device.

In embodiments, the first portion of the closure device attached to an inside surface of the at least one panel includes a loop portion of a hook and loop closure corresponding to a hook portion and the second portion of the closure device including a hook portion of a hook and loop closure and corresponding to the loop portion. In an embodiment, the second portion of the closure device is configured to mate with the first portion of the closure device and is attached to an outer surface of the pants, the first and second portions of the closure device being positioned so that when mated, the at least one panel is secured to the pants to cover at least a portion of the pants even when the wearer's legs are moved.

In an embodiment, the first portion of the closure device and the second portion of the closure device are from a group of coupling methods including, but not limited to hooks, snaps, magnets, buttons, adhesives, ball and socket, tie, or hook and loop. In embodiments, the weighted material is detachable from the skirt via a coupling method. In embodiments, the weighted material is detachable from the skirt via a coupling method from a group of coupling methods including, but not limited to hooks, snaps, magnets, buttons, stitching, adhesives, ball and socket, tie, or hook and loop.

In an embodiment, a skirt includes a top end configured to be worn about the waist of a wearer, a bottom end, and at least one panel of material extending downward from the top end. The skirt further includes pants having an upper portion and a lower portion, extending downward from the top end, and a coupling material coupled at one end to the at least one panel of material, and coupled to the pants at a second end. In embodiments, the coupling material is weighted. In embodiments, the coupling material is elastic. The term elastic as used herein is defined as flexible.

BRIEF DESCRIPTION OF THE DRAWINGS

The accompanying drawings illustrate various, non-limiting, examples, inventive aspects in accordance with the present disclosure.

DETAILED DESCRIPTION OF EMBODIMENTS OF THE DISCLOSED TECHNOLOGY

The below illustrated embodiments are directed to a modest athletic skirt. It is to be appreciated that the below illustrated embodiments are not limited in any way to what is shown, as the illustrated embodiments described below are merely exemplary of the disclosure, which can be embodied in various forms, as appreciated by one skilled in the art. Therefore, it is to be understood that any structural and functional details disclosed herein are not to be interpreted as limiting, but merely as a basis for the claims and as a representative for teaching one skilled in the art to variously employ the certain illustrated embodiments. Also, it is contemplated herein that the illustrated embodiments may be implemented in any combination that is practicable.

Unless defined otherwise, all technical terms used herein have the same meaning as commonly understood by one of ordinary skill in the art relating to the below illustrated embodiments. Although any materials similar or equivalent to those described herein can also be used in the practice or testing of the below illustrated embodiments, exemplary methods and materials are now described.

It must be noted that as used herein and in the appended claims, the singular forms "a," "an," and "the" include plural referents unless the context clearly dictates otherwise. Thus, for example, reference to "a weighted material" may include a portion of or a plurality of such weighted material and reference to "the panel of material" may include reference to one or more panels of material and equivalents thereof as known to those skilled in the art.

Figure 1:
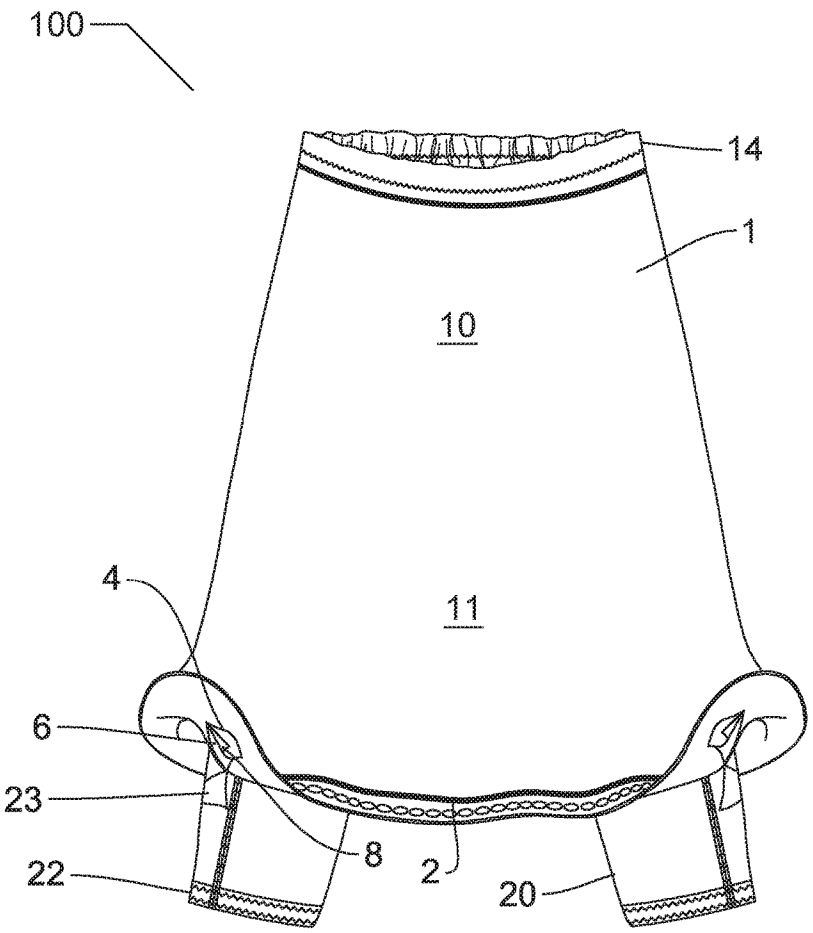
FIG. 1 is a front view of a modest athletic skirt in accordance with an embodiment of the present disclosure.

Turning now descriptively to the drawings, in which similar reference characters denote similar elements throughout the several views, FIG. 1 is a diagram of a modest athletic skirt 100 in accordance with an embodiment of the present disclosure. FIG. 1 shows a front view of a modest athletic skirt 100 in accordance with an embodiment of the present disclosure. The athletic skirt 100 includes a top end 14 configured to be worn about the waist of a wearer and at least one panel of material 1 extending downward from the top end 14 to a lower end 2. A weighted material 42 is coupled to a lower portion 11 of the at least one panel of material 1. In an embodiment, the skirt comprises pants 20 extending from the top end 14 towards the skirt's lower end 2. The top end 14 can function as a waistband in embodiments. In embodiments, the pants 20 can share the same waistband 14 providing the benefit and convenience of less bulky, sleeker top end 14, as two waistbands are bulkier and put more pressure on the rider's midsection.

In embodiments, the skirt panel of material 1 includes a front portion 10 that is configured to cover a front part of the wearer's body. The weighted material 42 can be coupled to a lower portion 11 of the panel of material 1, in embodiments. In an embodiment, the panel 1 extends toward a lower end 2, and the weighted material 42 is secured to the lower end 2. In embodiments, the weighted material 42 can be secured to either the lower portion 11, or in embodiments, to the lower end 2 of the panel of material 1, for example, but not limited to, adhesively, fastened with hook and loop closures, hook and eye closures, snaps or other means of coupling known in the art. In an embodiment shown in FIG. 1, the lower end is shown as a hem 2. The weighted material 42 is shown secured to the hem 2 in embodiments. In an embodiment, the weighted material 42 can be sewn or otherwise secured including, but not limited to, the methods previously listed, inside the hem 2, and hidden from view.

In embodiments, a closure 4 is situated above the lower end 2. The closure 4 (See FIGS. 2 and 4) provides additional means for keeping the panel 1 covering the area that includes the rider's waist to lower thigh or knee area, further discussed in FIGS. 2 and 4. In embodiments, stitching is visible on the skirt in a triangular shape 12 shown in FIG. 1, corresponding to the location of a closure component flap 33 of the closure 4 located on the inner surface 15 of the panel of material 1. In embodiments, the stitching around the perimeter of the exposed surface 12 can form any shape, for example but not limited to, a round and/or polygonal shape. The outer, non-functional surface 12 of the closure 4 can be seen in FIG. 1, in an embodiment.

Figure 2:
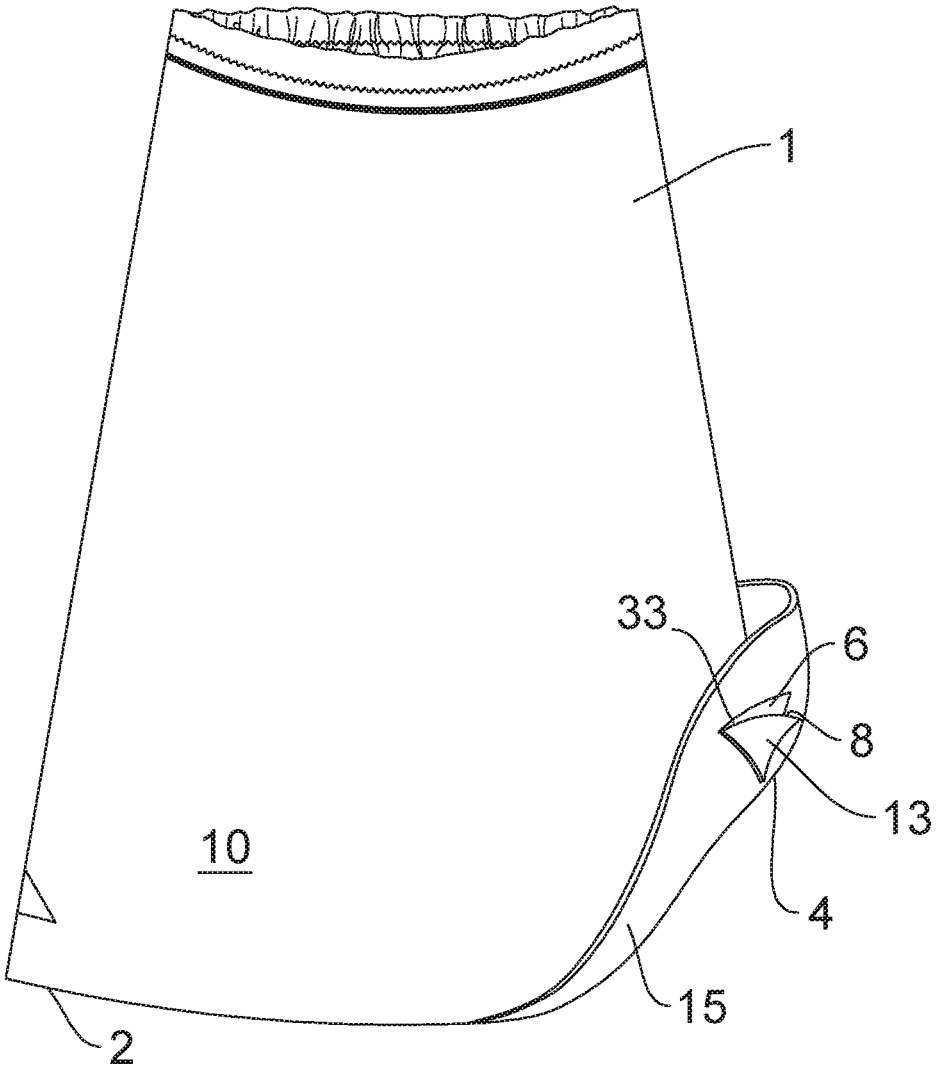
FIG. 2 is an additional front view of a modest athletic skirt in accordance with an embodiment of the present disclosure.

FIG. 2 is an additional front view of a modest athletic skirt in accordance with an embodiment of the present disclosure. An athletic skirt 100 having a panel of material 1 is shown alone, without pants 20 attached. An athletic skirt 100 not having pants 20 attached may be preferred for some who don't want to wear pants 20 or who choose to use their own pants 20, in embodiments. The skirt 100 is shown raised and one edge lifted up revealing the skirt's inner surface 15. In an embodiment, a closure component 8 is a surface located on the inner surface 15 of the panel 1, located above the lower end 2 of the panel of material 1. In embodiments, a closure component 6 functions by removably attaching to the corresponding surface 23 of closure component 24 located on the pants 20 that are a part of the athletic skirt 100. Closure component 8 serves as a cover surface for closure component 6, when closure component 6 is not in use, in embodiments. When a wearer implements the use of the closure components, the cover closure component 8 can be lifted off closure component surface 6, and the component surface 24 on the pants 20 can then removably attach to closure component 6, in embodiments. In an embodiment, a first portion of the closure device 4 and a second portion of the closure device 24, in embodiments, are from a group of coupling methods including, but not limited to hooks, snaps, magnets, buttons, adhesives, ball and socket, tie, hook and eye or hook and loop.

In an embodiment, the closure portions 4 and 24 include hook and loop closures. In embodiments, the skirt closure 4 comprises a flap 33 on the inner surface 15 of the panel of material 1 the flap 33 having a top surface 13, which can be an outer and exposed surface of the closure component 4. In an embodiment, the top surface of the flap 13 covers the hook portion 6, shown slightly open in FIG. 2, preventing the hook portion 6 from hooking onto and damaging, by pulling on the fibers of, any section of the pants 20 or skirt panel of material 1. In embodiments, when the flap 33 is opened and not covering the hook surface portion 6, the hook surface portion 6 is positioned to couple with the designated loop surface 23 segment of closure component 24 located on the pants 20. The inner surface 8 on the reverse side of the top surface of the flap 33 includes another loop surface 8 for the hook surface 6 to attach to when not coupled to the loop surface 23 of the pants 20, in embodiments. In embodiments, other methods of coupling using the closure component surfaces 8, 6, 23 to couple the panel of material 1 to the pants 20 can be used in lieu of the hook and loop surface, to ensure that the panel of material 1 remains in place, covering the wearer, for example, but limited to, adhesives, hook and eye, snap fit, ties, magnets, buckles, and those discussed below in FIGS. 4 and 5, and the embodiments shown in FIGS. 7 and 8.

In an embodiment, the panel of material 1 can extend from the waistband 14 until or about a lower portion 21 of the pants 20. The panel of material 1 can extend from the panel of material's 1 top end 14, until a minimum of at least 5 inches above the wearer's knees, in an embodiment. In embodiments, the panel of material 1 can extend until the wearer's knees, and anywhere in between 5 inches above the knees until the wearer's knees. In embodiments, the panel of material 1 can extend 0-2 inches right below the knees, or 3-5 inches below the knees. In embodiments, the skirt can extend to any length between, at minimum, from the midpoint of the wearer's thigh area, and at maximum, to the rider's ankles. In an embodiment, the panel of material 1 extends from the top end 14 up to the bottom end 2 and reaching right above or below the wearer's knee area. The closure 4, in embodiments, can be located above the knee, at the knee, or below the knee. In an embodiment, the closure 4 can be located below the wearer's knee, ensuring that the skirt covers farther below the knee.

Figure 3:
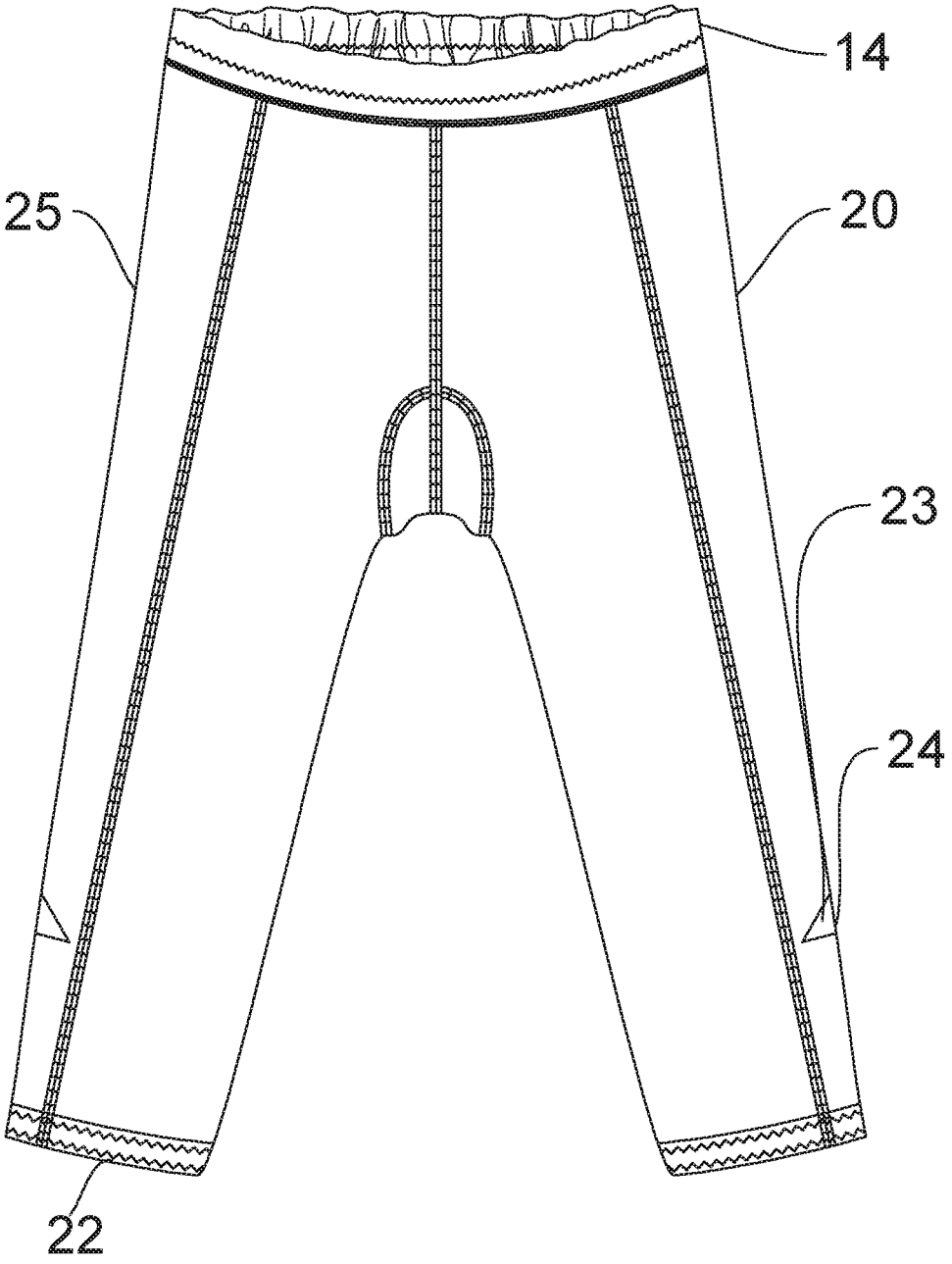
FIG. 3 shows pants 20, a partially internal component of the modest athletic skirt in accordance with an embodiment of the present disclosure.

FIG. 3 shows pants 20, a partially non-exposed component of the modest athletic skirt 100 in accordance with an embodiment of the present disclosure. The pants 20 can share the same waistband 14 providing the benefit and convenience of a less bulky and sleeker athletic garment, as two waistbands are bulkier. In embodiments, pants 20 extend from the shared waistband 14 to below the knee of the wearer. The pants 20 can be of any length and can reach a wearer's lower thigh, knees, calf, extend to the wearer's ankles, or to a point in between, in embodiments. In embodiments, the pants 20 are mostly concealed by the skirt, and only protrude a slightly beneath the skirt lower end 2. The pants 20 can extend beyond the skirt lower end 2 significantly in length, in embodiments, as well. In embodiments, the pants 20 may include a chamois 40, defined herein as padding for the crotch area, as known in the art.

In embodiments, the pants 20 are configured to extend until or below the wearer's knees, and the first and second portions 4, 24 of the closure device are positioned so that when mated, the panel of material 1 is secured to the pants 20 to cover the lower portion 21 of the pants 20. In embodiments, the lower portion 21 of the pants 20 includes at least a portion of the pants 20 that extends from the second third of the wearer's thigh area to the bottom end 22 of the pants 20. In embodiments, the lower portion 21 of the pants 20 include at least a portion of the pants 20 that extends from the midpoint of the wearer's thigh area to the bottom end 22 of the pants 20. In embodiments, the lower portion 21 of the pants 20 includes at least a portion of the pants 20 that extends from the midpoint of the panel of material 1 length to the bottom end 22 of the pants 20. The terms "until the wearer's knees" or "below the wearer's knees" refers to the pants 20 reaching right above the knees, or right below the knees, within two inches of the knees in either direction.

The pants 20 provides more coverage for a wearer, and also provides a medium to secure the skirt 100 in place, so that the skirt 100 doesn't hitch up or fly up with the wind while walking, riding or performing another physical activity. In embodiments, closures 24 can be located at or above the location of the wearer's knees in the pants 20. The closures can be positioned at any location between the area on the pants 20 corresponding to the wearer's thighs, and the area of the pants 20 corresponding to the wearer's shins or ankles. Some women may want the skirt 100 to be secured up to the knee, and the closure would be located below, at or above the knee. Other wearers prefer additional coverage, and would therefore prefer the closure to be placed at or below the knee, or even closer to the shin or ankle of the wearer, in embodiments.

Figure 4:
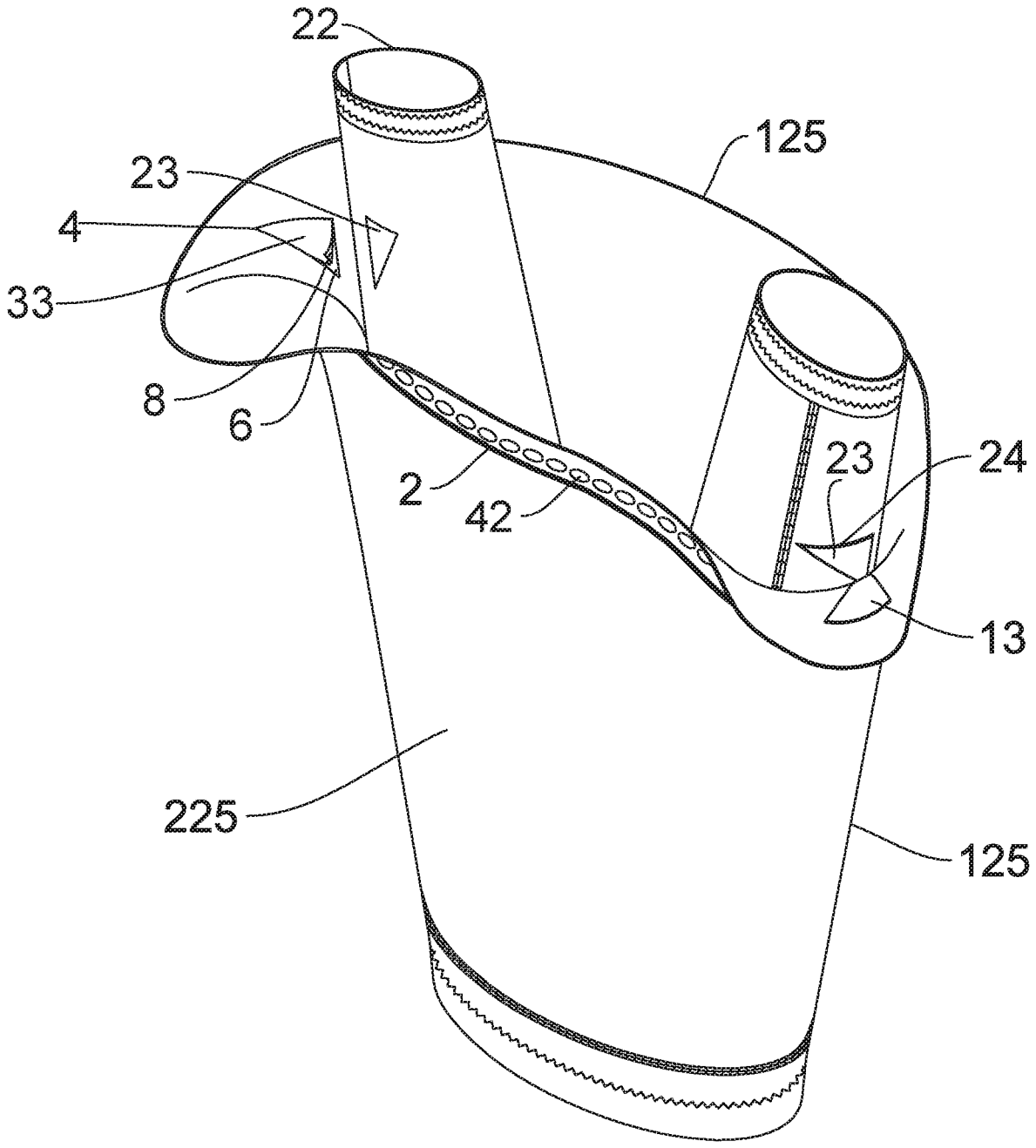
FIG. 4 is a perspective bottom, front, and side view of the modest athletic skirt in accordance with embodiments of the present disclosure.

FIG. 4 is a perspective bottom, front, and side view of the modest athletic skirt in accordance with embodiments of the present disclosure. The athletic skirt 100 is shown upturned, so that the inner surface 15 of the skirt and the inner surface of the pants 20 are visible. The pants 20 are seen to extend from the shared waistband 14 to the lower ends 22 of each pant leg 25. In embodiments, the pants 20 include a part of the hook and loop closure 24 that can be located on the pants 20 at or about where the wearer's knee is positioned. The outer surface 13 of the flap 33 of the closure component 4 on the panel of material 1 is visible, and in embodiments, has a loop material portion 8 incorporated onto the inner surface 8 of the flap 33, on the reverse side of the outer surface 13. In embodiments, the outer surface 13 provides a cover for the hook material portion 6 situated on the inner surface 15 of the panel of material 1. The flap 33 can be pulled open like a tab so that the hook portion 6 of the closure 4 on the panel of material 1 can be secured to the pants 20 loop portion 23.

In the embodiment shown in FIG. 4, the hem 2 is shown open and exposing the weighted material 42 inside the front portion of the hem 2. As discussed above in FIGS. 1 and 2, the weighted material 42 is located on a lower portion 11 of the panel of material 1 in embodiments, and is coupled to the panel of material 1 using various, though not limited to, coupling means listed above in describing FIG. 1, adhesively, fastened with stitches, hook and loop closures, hook and eye closures, snaps or other means of coupling known in the art. In embodiments, the weighted material 42 can be coupled to the lower end 2 of the panel of material 1.

The term weighted material 42 as used herein is defined as matter used to weigh down and maintain the position of the panel of material 42. Many different variations and configurations of weighted material 42 can be employed in embodiments. The hem 2 is shown in embodiments of FIG. 5 having weighted material 42 located within the hem 2. Endless permutations of the form, amounts and locations of weighted material 42 can be utilized in various embodiments of the present disclosure, with examples provided, but not limited to the examples described herein.

In embodiments, the weighted material 42 may be formed of natural plant fibers, natural inorganic matter, synthetic fibers, plastics, metals, glass, ceramic, wood, liquid filled bead, and any other material found in the art. The weighted material 42 can comprise of cubes, spheres, or otherwise shaped matter, sand or other powdered or liquid filled casing. The weighted material 42 can comprise one or more strands of weighted material 42 such as in embodiments shown in FIGS. 1-7. The term strand as used herein is defined as one segment having one or more individual components of weighted material 42. In an embodiment, one strand refers to any kind of fiber or material with weighted material coupled to it. In an embodiment, FIG. 4 can show an embodiment of a strand that is a thread-like fiber having weighted beads coupled together as weighted material 42.

Skirts used for activities such as cycling, may only necessitate weighted material 42 in the front portion 225 of the skirt, as the back portion 125 shown in FIG. 4 is secured under the sitting cycling wearer. Alternatively, one strand of weighted material 42 may be used for the back portion 125, while two strands of weighted material 42 can be used for the front portion 225, in embodiments. In embodiments, one or more strands or layers of weighted material 42 can be used uniformly along the front 225 and back portions 125 of the panel of material 1.

Figure 7:
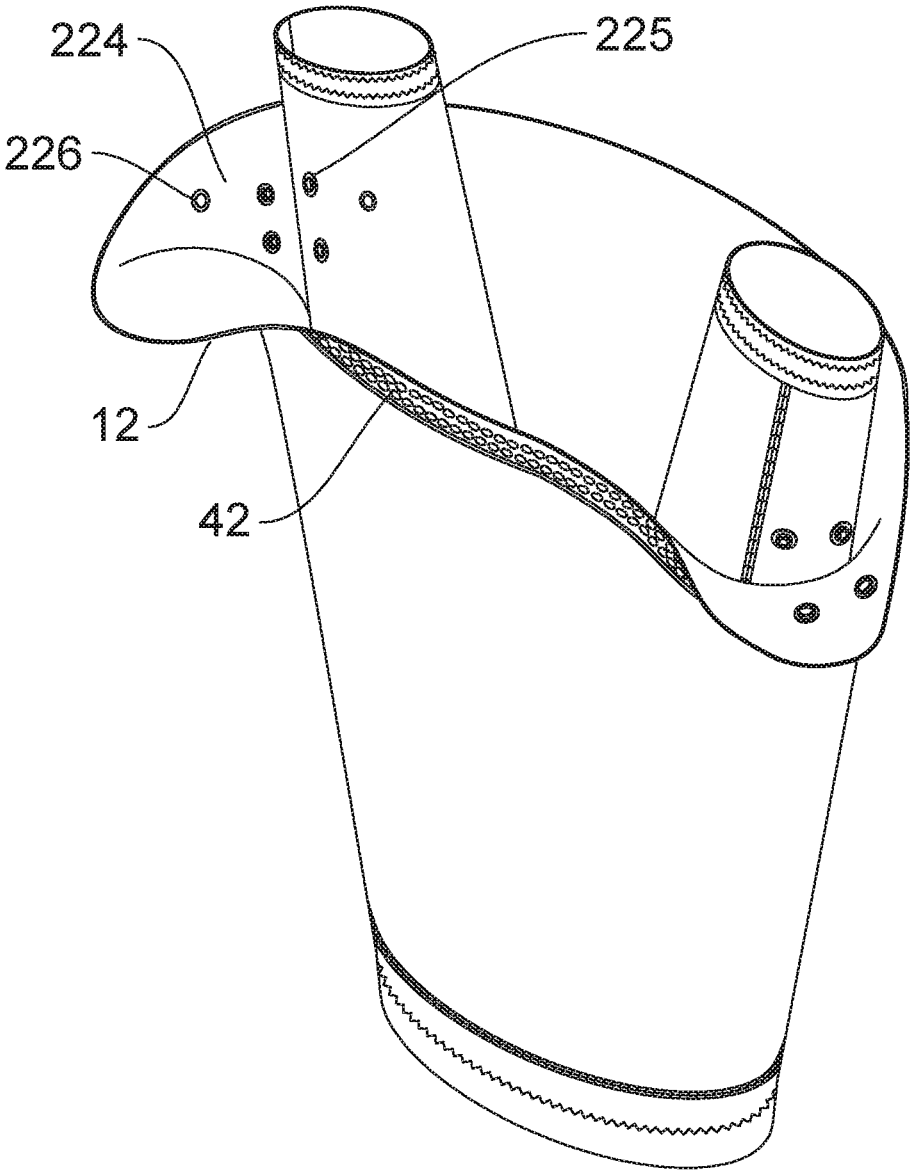
FIG. 7 is an additional perspective bottom, front, and side view of the modest athletic skirt in accordance with embodiments of the present disclosure.

The skirt 100 can have additional weighted material 42, such as two strands of beads shown in FIG. 7, running along the hem 2 of the front portion 225 of the panel of material 1. FIG. 4 shows an embodiment having one strand of weighted material 42, though in embodiments, two layers of weighted material 42 can be more effective to keep the front portion of the hem 2 of the skirt 100 down and covering the wearer. The weighted material 42 may extend all along the hem 2 of the skirt, in embodiments, or only extend along a portion of the panel of material 1, depending on the needs of the wearer. As discussed above, many materials have been listed, though not limited to those listed, and can be used as weighted material 42, in embodiments. In an embodiment, the weighted material 42 can be beads. The beads can be used independently, or strung on string. The shape of the weighted material can be round, spherical and/or polygonal or any combination of shapes.

Figure 5:
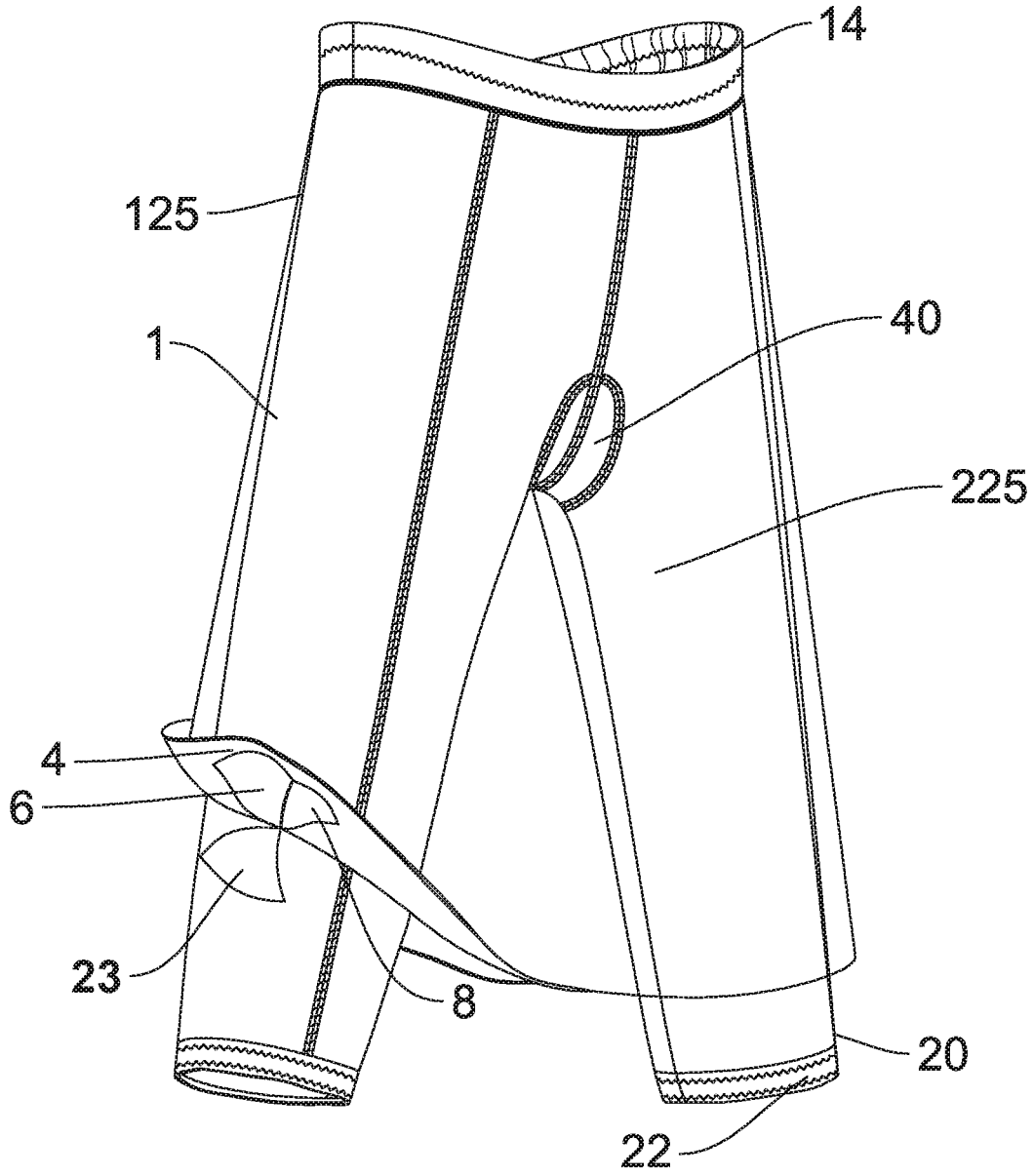
FIG. 5 is a front perspective view showing the modest athletic skirt as transparent and showing components of the skirt in accordance with embodiments of the present disclosure.

FIG. 5 is a front perspective view showing the modest athletic skirt 100 as transparent and showing components of the skirt in accordance with embodiments of the present disclosure. In the embodiment shown, the panel of material 1 and pants 20 are shown incorporated into one garment sharing the same waistband 14. The pants 20 and chamois 40 are visible through the panel of material 1 in embodiments, shown as transparent for illustration purposes. The closures 4, 24 of the panel of material 1 and pants 20 respectively are shown fastened, thereby securing the skirt to the pants, in embodiments. The outside surface 12 of the closure device 4 is visible from the outer surface of the panel of material 1 forming the athletic skirt and is shown in this embodiment in a triangular shape. Further embodiments can include a closure 4 having a surface of any shape including a round, circular shape, rhomboid, square, rectangular shape or any other round and/or polygonal shape. The closure portions 4, 24 can be a hook and loop closure, snap, hook and eye, adhesive, magnet, tie, or any other closure device known in the art. In an embodiment, the outer surface 12 of the closure 4 on the panel of material 1 is visible from the outer surface of the panel of material. In embodiments, on an opposite side of the panel of material 1 and on an opposite side of the visible surface 12 of the closure 4, lies the inner surface of the closure 8, covered by a flap 33. The flap 33 can have an inner surface 6, which can couple to a corresponding surface 23 on the pants 20. In an embodiment, the closure 4 can be a hook and loop closure. The closure surfaces 6 on the panel of material 1 and on the pants 20 can be pressed together, attaching the panel of material 1 to the pants 20.

Figure 6:
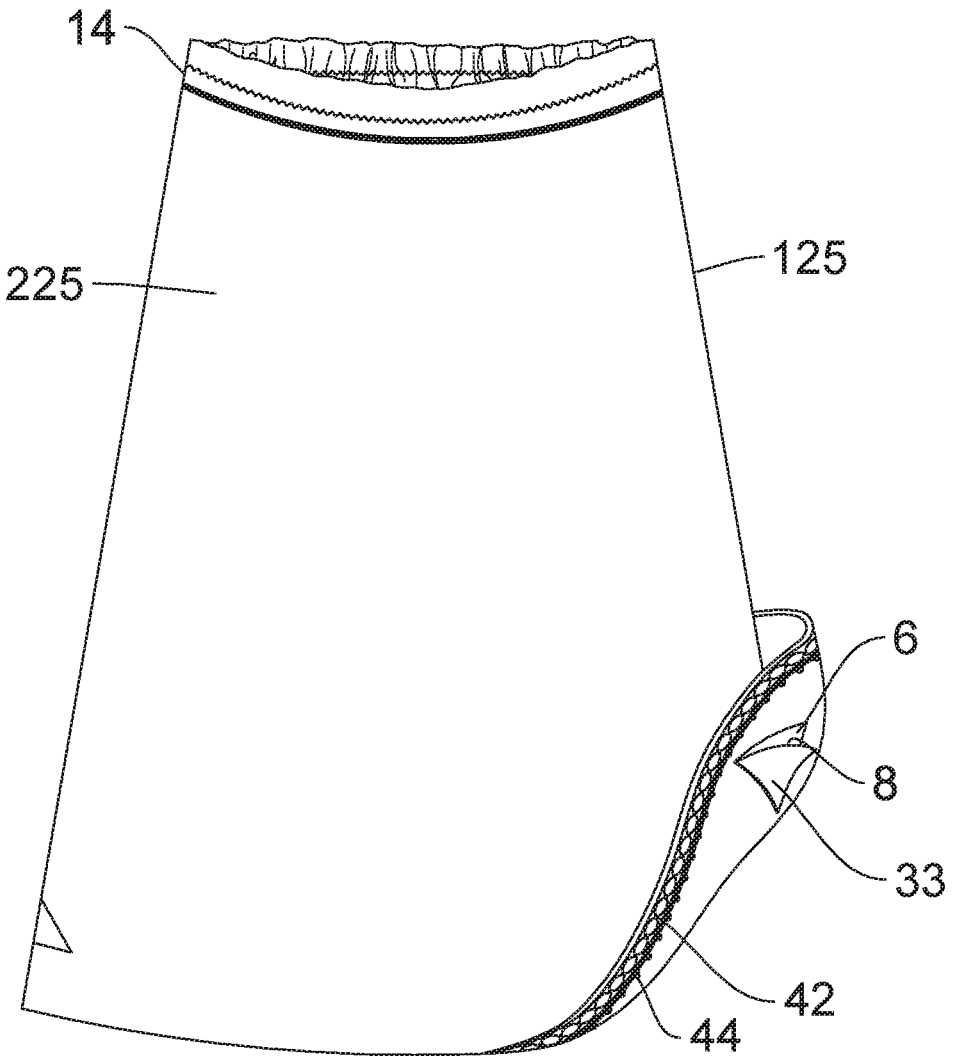
FIG. 6 is an additional front view of a modest athletic skirt in accordance with an embodiment of the present disclosure.

FIG. 6 is an additional front view of a modest athletic skirt in accordance with an embodiment of the present disclosure. FIG. 6 shows an embodiment of the weighted material 42 as strands of weighted material 42 coupled to the lower end 2 of the inner surface 15 of the panel of material 1, by methods such as but not limited to, sewing, using adhesives, snaps, and/or hooks to secure the weighted material 42 to the inner surface 15. In embodiments, the weighted material 42 is detachable from the skirt 100 via the above stated coupling methods, allowing a wearer to remove weighted material 42 if it is no longer necessary and/or uncomfortably heavy. In embodiments, the weighted material 42 is detachable from the skirt 100 via a coupling method from a group of coupling methods 44 including hooks, snaps, magnets, buttons, stitching, adhesives, ball and socket, tie, hook and eye, or hook and loop. For example, the weighted material 42 can be strung on or coupled to a string. The strand of weighted material 42 that is weighted material 42 coupled to a string, can be removably hung on a series of corresponding hooks coupled to the inner surface 15 of the panel of material 1.

FIG. 7 is an additional perspective bottom, front, and side view of the modest athletic skirt in accordance with embodiments of the present disclosure. In an embodiment shown, two strands of weighted material 42 are coupled to the front portion of the panel of material 1 at the lower end 2. In embodiments, no weighted material 42 may be necessary for the lower end 2 t of the back portion 125 of the panel of material 1. In an embodiment, one strand of weighted material 42 is coupled to the back portion 125 of the panel of material 1. In embodiments, one strand can be coupled to the lower end 2 of the back portion 125 of the panel of material 1, and two strands of weighted material 42 can be coupled to the front portion of the panel of material. In embodiments, a continuous strand of weighted material 42 may extend along the lower end 2 of the panel of material 1. In embodiments, portions of weighted material 42 can be coupled at locations on the lower portion of the panel of material 1.

The skirt includes a closure device 4 in embodiments, removably coupling the panel of material 1 to the pants 20. A first portion of the closure device and a second portion of the closure device, in embodiments, are from a group of coupling methods including hooks, snaps, magnets, buttons, adhesives, ball and socket, tie, hook and eye or hook and loop. FIG. 7 shows an embodiment of a closure 224 such as snaps being used where the protruding portion 225 of the closure snaps into and is into the hollow portion 226 of the closure 224, as an example of an embodiment of the closure device shown in FIGS. 1-6.

Figure 8:
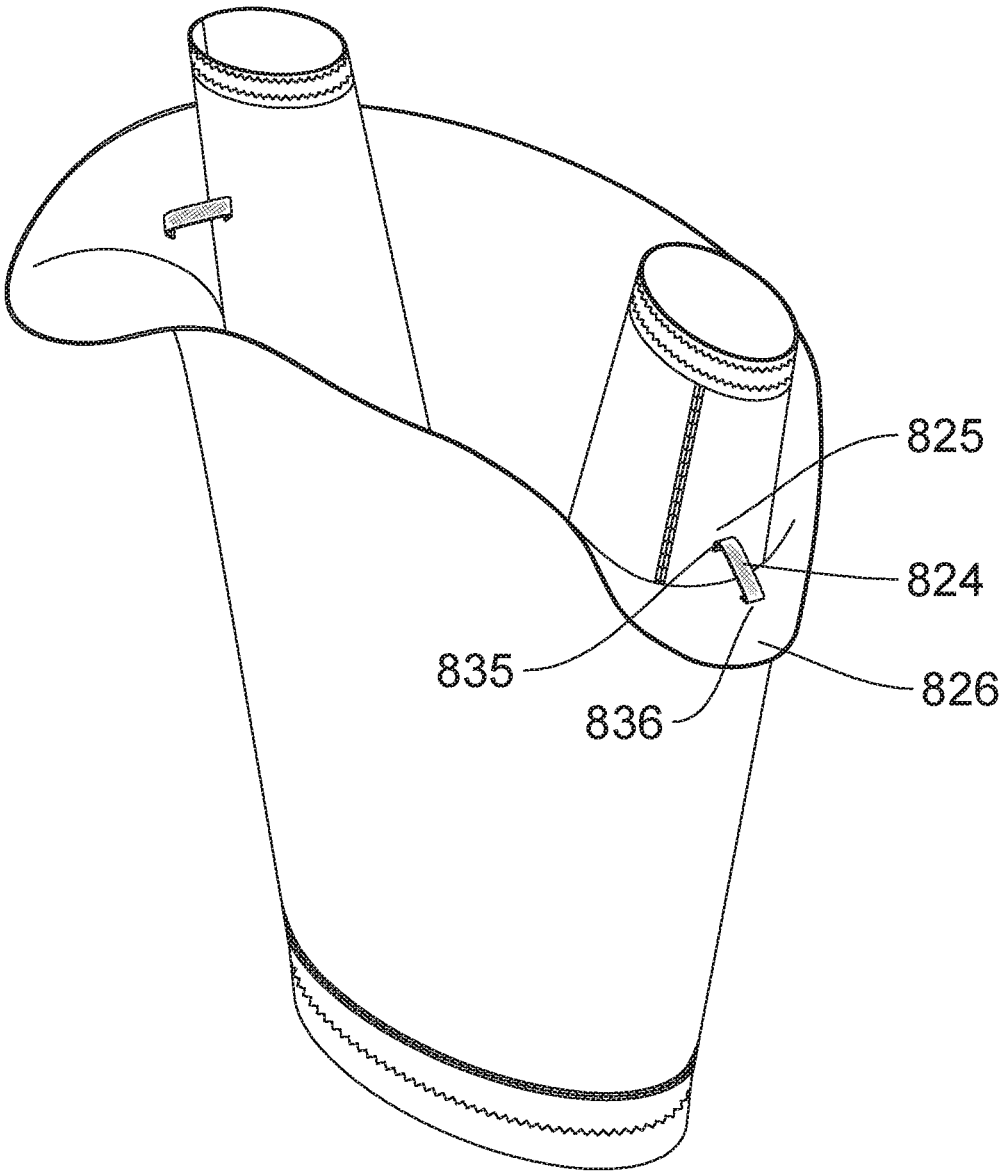
FIG. 8 is an additional perspective bottom, front, and side view of the modest athletic skirt in accordance with embodiments of the present disclosure.

FIG. 8 is an additional perspective bottom, front, and side view of the modest athletic skirt 100 in accordance with embodiments of the present disclosure. In an embodiment, the skirt 100 includes a top end 14 configured to be worn about the waist of a wearer, a bottom end 2, and at least one panel of material 1 extending downward from the top end 14. The skirt 100 further includes pants 20 having an upper portion 10 and a lower portion 11, extending downward from the top end 14, and a coupling material 824 coupled at a first end 836 to the inner surface of the at least one panel of material 1 at about the wearer's knee area 826, and coupled to the pants 20 at the knee area 825 at a second end 835. In embodiments, the coupling material 824 is coupled to a lower portion of the panel of material 1 at one end 836, and coupled to a lower portion of the pants 20 at a second end 835. The lower portion of the pants as used herein refers to the area at the lower half of the pants 20 meeting a wearer's knee, or to the area of pants below the wearer's knee, in embodiments.

In embodiments, the coupling material 824 is weighted. In an embodiment, the coupling material 824 comprises a lightweight material. In embodiments, the coupling material 824 is elastic. The term elastic as used herein is defined as flexible and stretchable. The coupling material 824 is coupled at each end by a coupling method for example but not limited to, sewing, adhesive, snap, snap fit, hook and loop and/or hook and eye. The elastic coupling material 824 allows for athletic movement by the wearer, by stretching and having "give" and elasticity, while still accommodating the wearer's desire for at least an upper portion of the skirt 100 to remain in place covering the wearer's upper thighs.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. An athletic skirt comprising:

at least one panel of material extending downward from a top end to a lower end, and the lower end having a hem that extends along the lower end of the at least one panel, and having at least two strands of weighted material fastened into a portion of the hem that extends along a lower end of the front portion of the at least one panel;

pants having a top end and extending downward, the top end of the pants attached to the top end of the skirt, and the at least one panel being configured to cover at least a portion of a front portion of the pants; and a first portion of a closure device secured to an inside surface of the at least one panel, having a hook portion of a hook and loop closure corresponding to a hook portion; and a second portion of the closure device having a loop portion of the hook and loop closure and corresponding to the hook portion, the second portion of the closure device being secured to an outer surface of the pants, and being configured to mate with the first portion of the closure device and, the first and second portions of the closure device being positioned so that when mated, the at least one panel is secured to the pants to cover at least a portion of the pants, even when the wearer's legs reposition;

wherein the at least one panel includes a front portion that is configured to cover a front part of the wearers body, the skirt further comprising:

a first portion of a closure device attached to an inside surface of the at least one panel;

a second portion of the closure device, the second portion of the closure device being configured to mate with the first portion of the closure device and being secured to an outer surface of the pants, the first and second portions of the closure device being positioned so that when mated, the at least one panel is secured to the pants to cover at least a portion of the pants even when the wearer's legs reposition.

2. An athletic skirt comprising: a top end and a lower end;

at least one panel of material extending downward from the top end to the lower end, and the lower end having a hem that extends along a lower end of the at least one panel, and having at least one strand of weighted material coupled to a portion of the hem that extends along a lower end of the front portion of the at least one panel; and pants having a top end attached to the top end of the skirt, the pants extending downward, and the at least one panel being configured to cover at least a portion of a front portion of the pants.

3. The skirt of claim 2, wherein the closure device is a hook and loop closure device.

4. The skirt of claim 2, wherein the weighted material is detachable from the skirt via acoupling method.

5. The skirt of claim 2, wherein the first portion of the closure device and the second portion of the closure device are from a group of coupling methods including hooks, snaps, magnets, buttons, adhesives, ball and socket, tie, or hook and loop.

6. The skirt of claim 2, wherein the weighted material is detachable from the skirt via acoupling method from a group of coupling methods including hooks, snaps, magnets, buttons, stitching, adhesives, ball and socket, tie, or hook and loop.

* * * * *